United States Patent [19]

Canale

[11] 4,060,917

[45] Dec. 6, 1977

[54] SOLE STRUCTURE PARTICULARLY FOR CLIMBING-BOOTS

[76] Inventor: Romolo Canale, Via Pastrengo, 3, Padova, Italy

[21] Appl. No.: 704,681

[22] Filed: July 12, 1976

[51] Int. Cl.[2] ..... A43B 23/28

[52] U.S. Cl. ..... 36/59 C; 36/32 R

[58] Field of Search ..... 36/32 R, 59 C, 113, 36/114

[56] References Cited

U.S. PATENT DOCUMENTS

| | | | |
|---|---|---|---|
| 2,433,303 | 12/1947 | Spini | 36/59 C |
| 2,981,011 | 4/1961 | Lombardo | 36/59 C |
| 3,006,085 | 10/1961 | Bingham | 36/59 C |
| 3,507,059 | 4/1970 | Vietas | 36/59 C |
| 3,717,943 | 2/1973 | Orndorff | 36/32 R |

FOREIGN PATENT DOCUMENTS

| | | | |
|---|---|---|---|
| 176,153 | 10/1951 | Austria | 36/59 C |
| 256,495 | 3/1949 | Switzerland | 36/59 C |

*Primary Examiner*—Alfred R. Guest

*Attorney, Agent, or Firm*—Guido Modiano; Albert Josif

[57] ABSTRACT

A sole structure particularly for rock climbing footwear, comprising a toe or front part and a heel or rear part. The toe and heel parts are both provided along the bottom perimeter thereof, substantially in the shape of a horseshoe, with a plurality of first lugs extending substantially perpendicular with respect to the perimeter or horseshoe path. Internally to the perimeter or horseshoe path, a plurality of second lugs extend in a direction substantially perpendicular to the sole longitudinal direction. The first and second lugs project from the sole with opposed inclinations with respect to a perpendicular direction to the sole.

1 Claim, 3 Drawing Figures

SOLE STRUCTURE PARTICULARLY FOR CLIMBING-BOOTS

BACKGROUND OF THE INVENTION

This invention relates to a footwear sole structure, particularly for mountaineering or rock climbing boots.

Such soles are at present generally made from rubber by a hot molding process.

A basic common feature of such sole structures is to be found in the pattern conferred to the lower or bottom side of said soles, i.e., on that part which comes in direct contact with the ground. That pattern must be such as to develop adequate adhesion forces, especially along exceptionally steep ground or rock.

To this aim, the lower side of said soles is provided with ribs or lugs which, in most instances, i.e., both on the sole proper and the heel, extend substantially perpendicular to the sole longitudinal direction and, in all instances, project perpendicularly from the sole bottom.

That constructional arrangement, i.e., where the ribs or lugs project perpendicularly from the sole, although currently adopted for the soles of all the mountaineering boots, seems incapable of ensuring adhesive power and anti-slip properties at their best, thereby it is not entirely devoid of shortcomings.

Indeed, if such lugs project perpendicularly from the sole, they also stand perpendicular to the ground whereon they are resting. Therefore, between the vertical walls of such ribs or lugs and the ground irregularities, which by wedging themselves in between such lugs come in contact and engagement with those vertical walls of said lugs — thus creating that frictional force or reaction which should prevent the sole from slipping — a sharp corner is formed; if the force exerted by the foot in a longitudinal direction becomes, even though only momentarily, greater than the frictional reaction, the sole slips, since between its lugs and the ground irregularities there is lacking that mutual engagement which created the frictional reaction.

Thus, to sum it up, the frictional reaction exerted by the sole against the ground is such as to overcome the force applied to the sole by the foot up to a given value, but once that value is exceeded, the frictional reaction becomes practically nil, thereby the wearer of the boots including such soles is caught unaware and may find himself in some danger.

SUMMARY OF THE INVENTION

It is a primary object of the present invention to provide a sole, particularly for rock climbing footwear, comprising at its lower side in contact with the ground contoured lugs which are bevelled, oriented and inclined such as to ensure a frictional reaction adequate to overcome any force applied to that sole.

It is a further object of the invention to provide a sole as mentioned above which is simple to manufacture and, accordingly, cost-wise advantageous.

These and other objects, such as will become apparent hereinafter, are achieved by a sole structure particularly for rock climbing footwear comprising essentially a toe or front part and a heel or rear part, wherein both said toe and heel are provided along the bottom perimeter thereof, substantially in the shape of a horseshoe, with a plurality of first lugs extending substantially perpendicular with respect to said perimeter or horseshoe path, and internally to said perimeter or horseshoe path, a plurality of second lugs extending in a direction substantially perpendicular to said sole longitudinal direction, said first and second lugs projecting from said sole with opposed inclinations with respect to a perpendicular direction to said sole.

BRIEF DESCRIPTION OF THE DRAWING

The invention will be now described in detail, with reference to the accompanying drawing, provided by way of example only, where.

DESCRIPTION OF PREFERRED EMBODIMENTS

Figure 1:
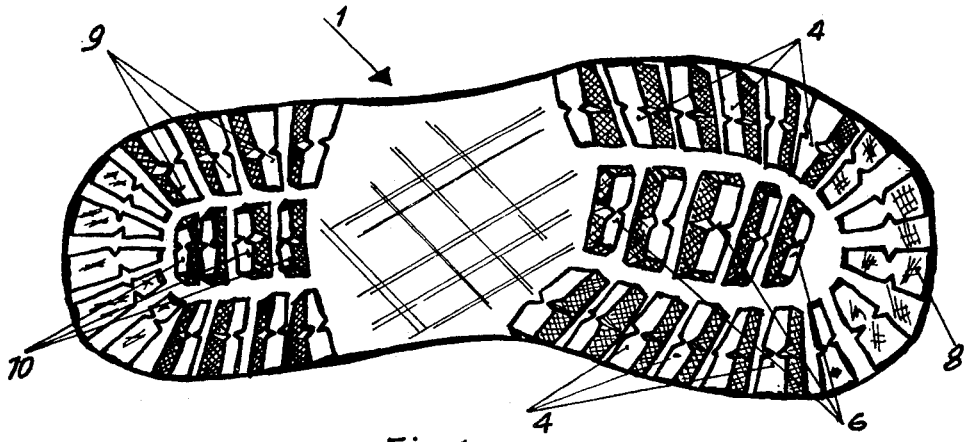
FIG. 1 is a plan view of the sole according to the invention.
Figure 2:
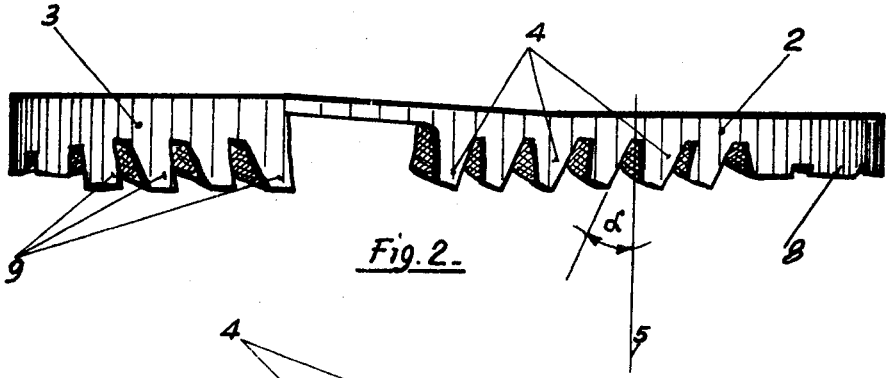
FIG. 2 is a side view of the sole of FIG. 1.
Figure 3:
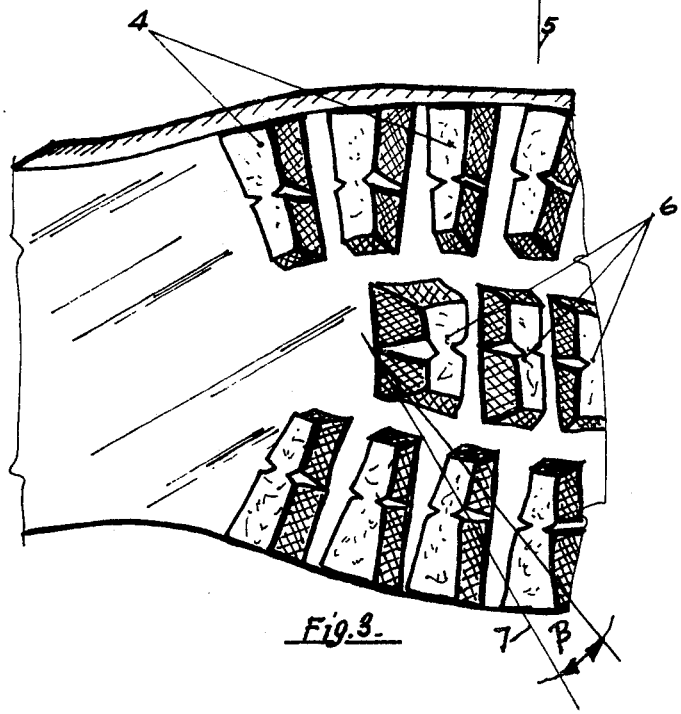
FIG. 3 is a view of an enlarged detail of FIG. 1.

With reference to the drawing Figures, the sole 1, of rubber, is a single piece structure obtained by a hot molding process. It comprises, at its lower area in contact with the ground, a toe or front part 2 and a heel or rear part 3.

The front part 2 is provided, at its perimeter of substantially horseshoe configuration, with a plurality of first lugs 4 formed integral with the sole 1 by hot molding the rubber, which extend in a direction substantially perpendicular with respect to said horseshoe-like perimeter extension. Furthermore, and advantageously, such lugs extend from the front part 2 with a given inclination angle $\alpha$, with respect to a line 5 perpendicular to the front part 2, being thus inclined toward the rear part 3 of the sole 1. Internally to said substantially horseshoe-like perimeter or path of the front part 2, second lugs 6 are provided which extend in a direction substantially perpendicular to the sole 1 longitudinal extension and project from the surface of the front part 2 under a given inclination angle $\beta$ with respect to a line 7 perpendicular to the front part 2, being thus inclined toward the toe, as denoted with the reference numeral 8.

In other words, while the lugs 4 are inclined toward the heel or rear part 3 of the sole 1, the lugs 6 are inclined toward the toe 8 of the sole.

The same applies to the rear part or heel 3 of the sole 1.

In fact, said heel 3 is provided with a plurality of first lugs 9, arranged along the horseshoe-like perimeter thereof, such lugs 9 extending longitudinally and projecting from the heel 3 surface with an inclination toward the toe 8 of the sole 1, i.e., in a direction opposite to that of the first lugs 4 of the front part 2.

Similarly to the description given above, and internally to the perimeter, substantially of horseshoe configuration, of the heel 3, there are formed second lugs 10, which extend in a direction substantially perpendicular wih respect to the longitudinal extension of the sole 1, i.e., in a direction opposite to that of the second lugs 6 of the front part 2 and project from the heel 3 surface with an inclination toward the rear part of the sole 1.

From the structural considerations set forth hereinabove, the operation of the sole according to the invention will be found self-explanatory. However, it may be briefly explained as follows.

When placed onto the ground surface, the sole 1 presents the lugs 4 and 10, contacting the ground surface, which are inclined toward the heel 3, whereas it presents the lugs 6 and 9 pointing toward the toe 8. Thus, the lugs 4 and 10, thanks to their inclination, produce, on contacting the ground, a certain frictional reaction, which, however, allows for the sole 1 a relative slip, to an extremely small extent, with respect to the ground, such that the resting enjoys a certain resiliency. If the force, from the foot transmitted to the sole 1, is of such magnitude as to cause the sole to slip with respect to the ground to an extent exceeding the extent mentioned above, the lugs 6 and 9 come into effect which, pointing toward the toe 8, create a frictional reaction which grows as the force applied by the foot to the sole 1 increases, thereby the sole is blocked with respect to the ground and any relative slip is prevented which may lead to a loss of adhesion.

Therefore, the sole 1, thanks to the inclinations of the lugs 4, 10 and 6, 9, is specially safe. In fact, when the forces applied to the sole 1 are very weak, the lugs 4 and 10 are quite capable of creating a frictional reaction sufficient to counteract, even though with a very moderate relative slip — favoring flexibility in use — such applied forces; while, for high forces, applied to the sole 1, the lugs 6 and 9 are capable of creating a sufficient frictional reaction to block the sole 1 with respect to the ground whereon the latter rests.

Thus, it will be apparent, both from the above considerations and the fact that the sole 1 may be obtained by hot molding, as a single piece and in a quick and simple manner, how the inventive sole fully achieves the objects intended.

It will be understood that any alternate embodiments linked together by the common utilization of the same novel inventive concept obviously fall within the scope of the instant application. Thus, for example, for special applications, it could be found convenient to incline the lugs 9 and 6 toward the rear and the lugs 10 and 4 toward the toe 8; and it will be apparent how such an arrangement would still make use of this inventive concept.

In practicing the invention, the materials, shapes and dimensions used may be any ones to meet different applicational requirements.

I claim:

1. A sole structure particularly for rock climbing footwear comprising essentially a toe or front part and a heel or rear part, both said toe and heel having along the bottom perimeter thereof, substantially in the shape of a horseshoe, a plurality of first lugs extending substantially perpendicularly with respect to said perimeter, and internally to said perimeter a plurality of second lugs extending in a direction substantially perpendicular to said sole longitudinal direction, wherein said first lugs and the adjacent second lugs project from said sole with opposed inclinations with respect to a perpendicular direction to said sole, said first lugs provided on said front part of said sole being inclined opposite to said first lugs provided on said heel and said second lugs provided on said front part of said sole being inclined opposite to said second lugs provided on said heel.

* * * * *